United States Patent [19]

Vallance

[11] Patent Number: 4,935,723

[45] Date of Patent: Jun. 19, 1990

[54] POLYMERIC SECURITY WINDOW

[75] Inventor: Michael A. Vallance, Chappaqua, N.Y.

[73] Assignee: General Electric Company, Schenectady, N.Y.

[21] Appl. No.: 396,401

[22] Filed: Aug. 21, 1989

[51] Int. Cl.[5] ..... G08B 13/04; G08B 13/16

[52] U.S. Cl. ..... 340/550; 310/322; 367/191

[58] Field of Search ..... 340/550; 310/322; 367/191

[56] References Cited

U.S. PATENT DOCUMENTS

| | | | |
|---|---|---|---|
| 3,889,250 | 6/1975 | Solomon | 340/550 |
| 3,946,377 | 3/1976 | Zetting | 340/550 |
| 4,023,156 | 5/1977 | Galvin | 340/550 |
| 4,112,420 | 9/1978 | Mifune et al. | 340/550 |
| 4,142,188 | 2/1979 | Zetting et al. | 340/550 |
| 4,367,460 | 1/1983 | Hodara | 340/550 |

*Primary Examiner*—Glen R. Swann, III

*Attorney, Agent, or Firm*—William H. Pittman; James C. Davis, Jr.

[57] ABSTRACT

A security window is a laminated pair of polymeric window panels having waveguides sandwiched therebetween for transmission of ultrasonic compression waves. The waveguide transmission medium is glass fibers extending from edge to edge of the plastic panels and distributed in plastic strips which cover the entire window area. The index of refraction of the glass fibers is as identical as possible to that of the surrounding plastics, making the waveguides substantially invisible. A transducer initiates an ultrasonic compression wave which travels the length of the waveguide, and is detected by a transducer at the other end of the waveguide. The received signal amplitude diminishes when the waveguide is damaged and such change is used to trigger an external alarm system.

23 Claims, 2 Drawing Sheets

POLYMERIC SECURITY WINDOW

FIELD OF THE INVENTION

This invention relates generally to a security window of the type including means for detection of damage thereto and, more particularly, concerns a polymeric window having invisible damage protection means molded therein.

BACKGROUND OF THE INVENTION

Prior art burglar alarm systems in elemental forms involving glass panels have the disadvantage that sensing elements on or embedded in the glass are visible, which defeats the purpose of glass. For example, thin, electrically conductive tapes or strips have been applied to the glass periphery in a substantially complete loop. When the glass is broken, the tape is severed and an electrical circuit is broken. This initiates a chain of electrical events resulting in the production of a signal indicating that the glass has been broken. However, such tapes are usually visible. Therefore, they are positioned only around the periphery of the glass area so as not to obstruct the view. Large areas of glass are unprotected and a skilled burglar intent on entry may cut the glass while avoiding the electrically conductive tape. Alternatively, a small hole may be cut through the glass in an area where the tape is absent, through which the burglar reaches in and short circuits the tape between its entry and exit points on the glass panel. As a result, no alarm is ever produced when the glass is broken, even though portions of the tape may be severed. The metallic tape may also be unattractive, as well as obstructive, in the environment of the glass panel.

Recently, systems have been devised which respond to sounds or other vibrations produced by intruders. Unfortunately, normal ambient sounds and vibrations may be at a higher level than those caused by a burglar breaking a glass panel. Thus, many false alarms may result in such systems.

What is needed is a security window which provides protection over the entire window area and which is invisible or substantially invisible to the human eye.

Accordingly, it is an object of this invention to provide an improved security window which contains integral intruder detection sensors which are not visible.

Another object of the invention is to provide an improved security window which contains intrusion detection sensors over any desired window area without significantly affecting window transparency.

A further object of this invention is to provide an improved security window which is damage resistant and not subject to false alarms in operation.

Yet another object of this invention is to provide an improved security window which uses conventional plastic window materials and is economic to produce.

SUMMARY OF THE INVENTION

Generally speaking, in accordance with the invention, a polymeric security window is provided, which is especially suitable for applications requiring excellent transparency. The security window is a lamination of a pair of polymeric window panels having sandwiched therebetween waveguides for transmission of ultrasonic compression waves. The primary waveguide transmission medium is composed of glass fibers extending from one edge of the plastic panels to the opposite edge and distributed in strips which cover the entire window area. The glass fibers are sealed in a plastic which preferably is the same material which serves as the polymeric window panels. The index of refraction of the glass fibers is selected to be as identical as possible to that of the surrounding plastics, so that minimum distortion of images results when viewing objects through the window. For all practical purposes the waveguides are invisible.

A transducer connected at one end of each waveguide initiates an ultrasonic compression wave which travels the length of the waveguide, and it is detected by a receiving transducer and appropriate electronic circuitry, when received at the other end of the waveguide. The amplitude of the received signal diminishes when the waveguide is severed, partially severed or punctured. Deviation in amplitude of the received signal resulting from such damage to the waveguide is used to trigger an external alarm system.

Such waveguides may be incorporated into polymeric windows now in general use.

Other objects, features and advantages of the invention will in part be obvious and will in part be apparent from the specification.

This invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
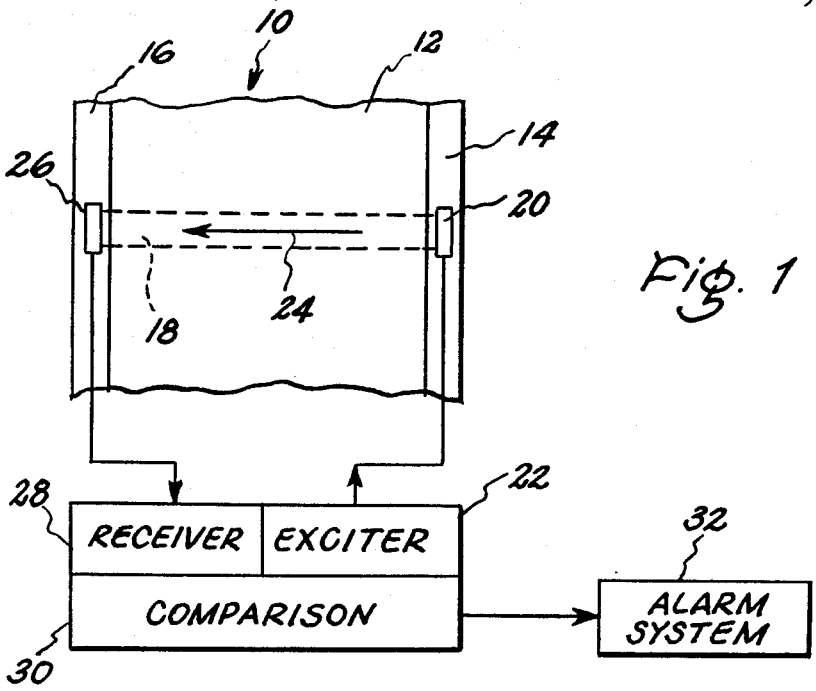
FIG. 1 is a fragmentary front view of a security window in accordance with the invention.

A security window 10 embodying the invention includes a window panel 12 laterally bounded by frame members 14, 16. A waveguide 18, as described more fully hereinafter, is contained within the window panel 12 and extends between the window frame members 14, 16. An excitation transducer 20, when excited by electronic circuits 22, induces an ultrasonic compression wave in the waveguide 18. The compression wave, indicated by the arrow 24, travels the length of the waveguide 18 and is picked up by a receiving transducer 26. The transducer 26 converts the compression wave to an electrical signal, which is provided as an input to receiving circuits 28. There the received signal is compared against a standard representing performance of the waveguide 18 under normal operating conditions when no physical impairment has been inflicted upon the window panel 12. In such situations, comparison circuits 30 associated with the exciter 22 and receiver 28 do not provide a signal output which activates an associated alarm system 32. However, if the waveguide 18 is damaged, for example, by being partially severed, punctured, or entirely severed, the wave, if any, received at the receiving transducer 26 and the signal resulting at the receiver 28 will compare unfavorably against the acceptable standards of waveguide performance. In such instances, a signal from the comparison circuits 30 activates the alarm system 32.

Each waveguide 18 embedded in the window panel 12 is substantially invisible in most instances. The number of such waveguides and the spacing of the waveguides is determined by the intended application of the security window 10. For example, if the security window 10 is protecting a jeweler's showcase, the waveguides may be spaced sufficiently close so that no object of displayed jewelry can pass through the space between adjacent waveguides. Thus, anyone cutting a hole or in any manner forming a hole in the window panel 12 which is sufficiently large to pass jewelry therethrough will need to make an opening which results in damage to at least one waveguide.

To improve sensitivity of the system, the waveguides are excited separately and in a predetermined sequence. Thus, damage to even one waveguide is readily detected. In such a construction with a plurality of waveguides 18, suitable synchronized, automatic switching means (not shown) are interposed between the circuits 22 and the excitation transducers 20, and between the receiving transducers 26 and the receiving circuits 28, to allow separate evaluation of the individual waveguides 18 with any preferred sequence and timing.

The electronic circuitry 22, 28, 30 and the alarm system 32 are conventional components, are not novel portions of this invention and accordingly are not described in detail herein. The compression wave transducer 20 is of a conventional type, typically a broad band transducer with an operating frequency in the 0.5 MHz to 50 MHz range, for example, a piezoelectric element, such as quartz crystal. The transducer is designed and oriented so as to generate and/or receive compression waves. The receiving transducer 26 is of similar construction.

Figure 3:
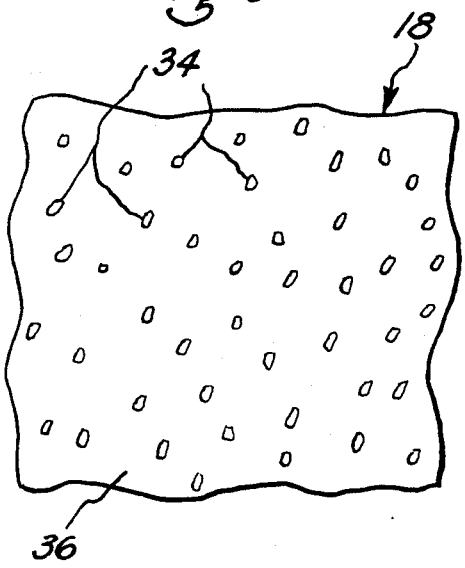
FIG. 3 is a sectional view along the line 3—3 of FIG. 2 and looking in the direction of the arrows.

The waveguide 18 preferably includes a highly collimated tow of fibers 34 having a high modulus of elasticity, that is, having a modulus of elasticity, E, equal to or greater than ten million psi at frequencies used for the compression waves, for example, one megahertz. The glass fibers 34, typically E-glass fibers, are embedded in a polymeric material 36 to form a waveguide 18 as seen in FIG. 3. Glass fibers 34 represent forty to seventy percent of the waveguide volume. The polymeric material 36 has the following desirable characteristics, namely, good optical properties and an index of refraction matched closely with the index of refraction of the fibers 34. Also desirable is a material 36 providing good adhesion to the fibers 34, toughness, that is notch insensitivity, high strength and good formability. Polycarbonates and acrylic-modified polycarbonates serve well for this purpose.

To assure that the good optical properties of the selected polymeric material are not lost when combined with the fiber tow it is necessary that the fibers be thoroughly surrounded by the polymeric material. That is, the fiber tow must be completely impregnated with the polymeric material. Such impregnation may be accomplished simultaneously with the formation of the plastic waveguide 18. For example, the fiber tow may be sandwiched between two half-thickness sheets of the selected polymeric material. Then the fibers and the polymeric material are laminated to form a thick sheet with embedded fibers 34. Alternatively, the tow of collimated fibers 34 may be pre-impregnated with resin either by solution or hot melt routes known in the art.

Pultrusion offers one such method and pultrusion of these rods with, for example, cyclic polycarbonate oligomers of the type disclosed in U.S. Pat. No. 4,740,583, is an acceptable method for producing waveguides 18. In this method, the tow is pulled through a low viscosity resin bath such that the resin sticks to the fibers. The tow is then pulled through a die with a rectangular cross section thereby producing a ribbon-like rod of extended length having the glass fibers running lengthwise therein. Where cyclic prepolymers, such as polycarbonate oligomers, are used to contain the fiber glass tow, these materials can be polymerized during formation of the waveguide or subsequently during lamination into the window panels 12.

The waveguides 18 are formed as flat bars (FIG. 2) in cross section. A typical waveguide would have a height 40 of ½ inch and a thickness 42 in the order of 20 mils (0.020 inches).

Figure 2:
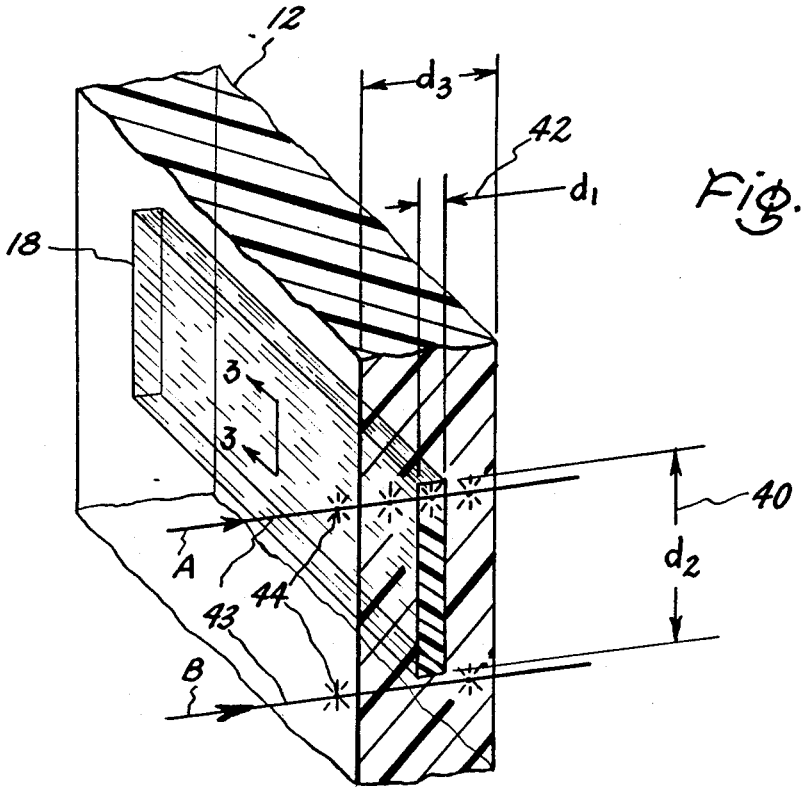
FIG. 2 is a perspective view of the window of FIG. 1, with parts omitted to simplify description.

Such flat waveguides 18 have advantages. Namely, they are easily produced using slit or roller dies. They are produced with minimal void content, because direct pressure is easily applied over most of the perimeter and the path length for escaping gases is relatively short. The thin flat waveguides 18 fit easily between sheets of polymeric materials to which they are laminated by the application of heat and/or pressure. Also, as illustrated in FIG. 2, the waveguides 18 offer minimal path length (thickness 42) to impinging light 43. Because exact index of refraction matching between the fibers 34 and the resin 36 (FIG. 3) is impossible, minimizing the thickness 42 has the advantage of minimizing opacity due to light scattering, and minimizes striped patterns which occur in window panes due to different transmissivity, for example, at locations where the light 43 passes through the waveguide 18 in comparison with locations where the light passes through the window panel 12 without passing through the waveguide 18. Starburst patterns 44 are included in FIG. 2 to indicate interfaces between the ambient air and the window panel 12, and between the window panel 12 and the waveguide 18 through which rays 43 of light pass in travelling through the window 10.

Additionally, for a given number of glass fibers 34 within the waveguide 18, a maximum cross section to any physical penetration is presented when the waveguide 18 is a flat strip as illustrated in FIG. 2, and penetration of the window 10 is more likely to intersect the waveguide 18 when the waveguide height 40 is large, based on probabilistic considerations.

Figure 4:
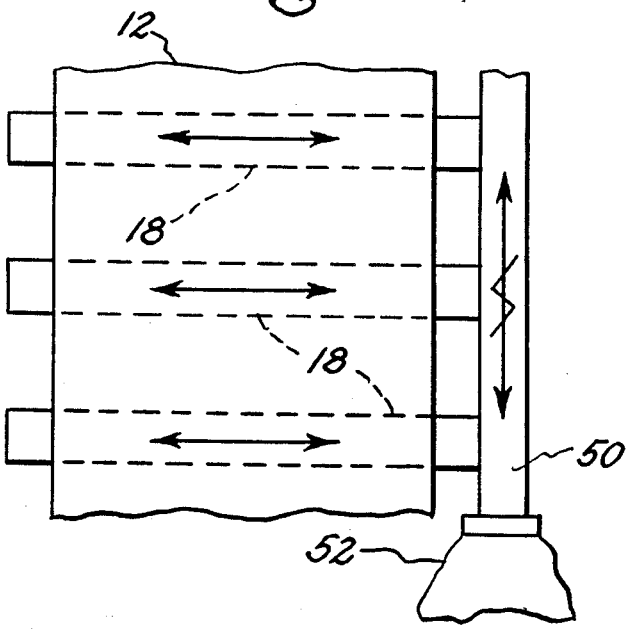
FIG. 4 is a view similar to FIG. 1 showing an alternative embodiment of a security window in accordance with the invention.

In most window applications of the security system in accordance with the invention, a plurality of waveguides 18 extend in parallel between the window frames 14, 16. FIG. 4 illustrates such a window containing a plurality of parallel waveguides as described more fully hereinafter.

Whereas the advantages of a rod-type waveguide 18 as illustrated in FIGS. 1 and 2 have been discussed above, it should be understood that in alternative embodiments of a security window system in accordance with the invention, the waveguide need not be limited to such a rectangular cross-section. The waveguide need not be straight and need not be perpendicular to parallel side window frames 14, 16 as illustrated in FIG. 1. The cross-section of the waveguide 18 may be of any shape so long as good impregnation of the glass fibers therein is accomplished. The waveguide may be, for example, a loop encircling the window panel periphery with both the transmitting or generating transducer and the receiving transducer mounted to the same portion of window frame. Where the waveguide deviates from linearity, it is understood that ultrasonic energy transmission losses will be higher than in straight runs. In every case gradual curves should be incorporated. The cross section of FIG. 3 is intended to illustrate glass fibers 34 embedded in the polymeric material 36 and is not intended to indicate that the fiber cross-section need be round. Other cross sectional shapes, as are available or become available, may be suited to this application.

The polymeric material 36 and high modulus glass fibers 34, which reinforce the polymeric material 36, in combination transmit the compression waves in accordance with well-known wave phenomena. The major proportion of the compression energy in the waveguide 18 does not cross an interface to enter the surrounding window panel 12 but rather reflects back into the waveguide 18 because the glass reinforced waveguide 18 provides a different acoustic impedance from the panel 12. This is true even when the window panel 12 and the matrix material 36 are the same. Thus most of the energy tends to stay in the waveguide 18 as the wave moves longitudinally from one end of the waveguide to the other end.

Optimally, the resin 36 used to form the waveguide 18 is the same resin as used in the panel 12. The waveguide 18 is laminated between two sheets of plastic which form the panel 12. Residual stresses may exist due to a mismatch in coefficient of thermal expansion between the glass fibers 34 ($\alpha_f$) and the resin 36 ($\alpha_r$) even when the resins of the panels 12 and waveguide 18 are the same. Mismatch in coefficient of thermal expansion is a source of light scattering and polarization of the impinging light. In such instances the view through the window will not be uniform and a striped pattern may be apparent in any window panel, whether made of plastic or conventional glass. The problem of mismatched thermal expansion coefficients is minimized by prestraining the fibers of the waveguide 18 during the lamination cycle and releasing the prestress (tension) on the fibers after cool-down. The proper amount of prestrain to apply to the waveguide 18 before lamination into the window panel 12 is readily calculated from a knowledge of the expansion coefficients, the resin's glass transition temperature Tg, and ambient temperature Ta. The fiber glass tows are stretched before impregnation to a strain of $(\alpha_r-\alpha_f)$ (Tg−Ta) which corresponds to a stress of $E_f(\alpha_r-\alpha_f)$ (Tg−Ta). After impregnation and cool-down, the tension (stress) on the fibers 34 is released. The result is that the fibers 34 and the surrounding plastic 36 are in stress-free states. Thus, distortions which might be introduced by the waveguide 18 per se are reduced.

Each transducer 20, 26 is designed and oriented so as to generate and receive compression waves respectively. The transducers are affixed to the ends of the waveguide 18 so that minimal energy is reflected by the transducer-rod interfaces. This is accomplished by methods known to those skilled in the art, for example, a liquid fills the interstices between the transducer and waveguide. To facilitate transducer attachment, the waveguides extend beyond the lateral edges of the window panel 12. This additional length of waveguide also facilitates prestressing of the waveguide, as described above, without affecting those portions through which light must pass. The overall construction is such that the frame members 14, 16, which support the window panel 12, also conceal and protect the ends of the waveguide 18 and transducers 20, 26, and further serve as conduits for cables connecting the transducers to the electronic circuitry 22, 28.

In operation, the generating transducer 20 is pulsed periodically, for example, once each second. The receiving transducer 26 at the other end of the waveguide 18 is excited by the compression wave after it traverses the length of the waveguide. The structure of resin reinforced with glass fibers acts as a waveguide and contains the energy because its longitudinal Youngs' modulus E is in the order of twenty times higher than the Youngs' modulus of the surrounding thermoplastic.

A simple threshold detector may be used to detect penetration of the window panel 12 which physically modifies a waveguide 18. In normal operation, the received signal always exceeds the threshold level and no alarm is sounded. If the waveguide 18 is altered physically, the received signal is deteriorated. When the signal falls below the threshold level, the circuits 28, 30 provide a signal to the alarm system 32. Alternatively, the received signal from each compression wave may be compared with the received signal from the prior compression wave. Changes between two consecutive signals exceeding a certain magnitude may be used to trigger the alarm system 32. As stated, the electronic circuitry is not considered to be a novel portion of the invention and those skilled in the art will readily find many options for receiving and utilizing the signals produced by the receiving transducer 26.

As stated above, in practical applications, a physically parallel array of waveguides 18 is employed. These waveguides 18 are scanned and pulsed sequentially so that only one electronic package is required for monitoring all of the waveguides. Similarly, multiple windows 12, each with multiple waveguides 18, may be excited and monitored from a single electronics package on a time-shared basis. The spacing of these waveguides 18 is selected for the particular application, that is, the particular type and size of window penetration event which must be detected.

The receiving transducers 26 are connected to the waveguide 18 by techniques known in the art to minimize reflection of energy within the waveguide 18. However, in alternative embodiments in accordance with the invention, the receiving transducer 26 is omitted from each waveguide 18. The compression energy travels the length of the guide and is reflected at the end of the waveguide. Reflected energy is received by the same transducer 20 which generates the compression wave via so-called "pulse-echo geometry" or by another transducer intended for reception. The intensity of the reflection indicates the condition of the waveguide 18 relative to any penetrations or severance and the returned signals are processed in a manner similar to those described above to determine whether or not an alarm condition exists.

FIG. 4 illustrates an alternative embodiment of a security window system in accordance with the invention wherein the waveguides 18 operate in a reflective mode, that is, the compression wave is generated and the reflected wave is detected at the same end of the waveguide 18. A single bar 50 traverses and attaches to one end of each of the waveguides 18, with the opposite end of each waveguide left free. A shear transducer 52, for example, a quartz crystal cut in a known manner to produce shear waves when excited, connects at one end of this bar 50 causing the entire bar 50 to act as a wave conductor. The frequency of excitation of the shear transducer 52 and the acoustic impedance in shear of the bar 50 are chosen, by well-known techniques, to develop a half wave length on the order of the height 40 of the waveguides 18. The shear transducer 52 induces a deflection in the bar 50. The deflection, which is transverse to the length direction of the bar 50, travels lengthwise along the bar 50 as a wave. The transverse waves induce compression waves in the waveguides 18 in passing by the attachment points to the waveguides 18. The reflected compression waves in the waveguides 18 excite transverse waves in the bar 50, which waves travel the bar 50 and excite the transducer 52 sequentially, since the path lengths for each waveguide 18 to the transducer 52 are different one from the other.

In an alternative embodiment in accordance with the invention, a shear type transducer is used for excitation as in FIG. 4, and compression type transducers serve as receivers at the far end of the waveguides 18, as in FIG. 1, without reliance on reflected energy.

It will thus be seen that the objects set forth above and those made apparent from the preceding description are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. A security window system comprising:

a window panel;

a waveguide having first and second ends and extended length therebetween, said waveguide being joined to said window panel, said waveguide having a different acoustic impedance for compression waves than that of said window panel.

2. A security window system as claimed in claim 1, wherein said waveguide includes a plurality of glass fibers oriented in the lengthwise direction of said waveguide between said ends.

3. A security window system as claimed in claim 2, and further comprising means for introducing a compression wave into said first end of said waveguide, said compression wave being transmitted toward said second end;

means for detecting said compression wave arriving at said second end of said waveguide;

means for comparing a characteristic of said detected compression wave against a preselected standard of waveguide transmission performance, and for producing a signal indicative of deviation of said arriving wave from said standard.

4. A security window system as claimed in claim 3, wherein said means for introducing includes a transducer means at said first waveguide end for generating a compression wave in said waveguide in the lengthwise direction thereof, and means for controlling said transducer means in generating said compression wave.

5. A security window system as claimed in claim 4, wherein said transducer means is a piezoelectric element.

6. A security window system as claimed in claim 3, wherein said means for induction includes a shear transducer at said first waveguide end, said shear transducer being adapted for application of an intermittent transverse wave to said first end of said waveguide, said transverse wave inducing a compression wave which moves lengthwise in said waveguide, and means for driving said shear transducer to apply said transverse wave.

7. A security window system as claimed in claim 6, wherein said means for induction further includes a wave conductor connected between said shear transducer and said first waveguide end, said transducer, when excited, inducing said transverse wave in said conductor, said transverse wave travelling lengthwise in said wave conductor to said first waveguide end.

8. A security window system as claimed in claim 2, wherein said waveguide comprises said plurality of fibers contained in a rod formed of a plastic, said plurality of glass fibers and said plastic having one of the same and substantially the same index of refraction to light, and wherein said window panel is formed of plastic, said plastic of said rod and said plastic of said window panel having one of the same and substantially the same index of refraction to light.

9. A security window system as claimed in claim 8, wherein the connection of said waveguide to said window panel is the product of application of at least one of heat and pressure.

10. A security window system as claimed in claim 8, and further comprising a second window panel similar to said first-recited window panel, said second panel being joined to said waveguide and said first-recited panel, said waveguide being positioned between said panels.

11. A security window system as claimed in claim 2, further comprising means for introducing a compression wave into said first end of said waveguide, the second end of said waveguide being at least partially reflective of compression waves;

means at said first waveguide end for detecting reflections of said compression wave from said second end;

means for comparing a characteristic of said detected reflected compression wave against a preselected standard of waveguide transmission and reflection performance and for providing a signal indicative of deviation of said received reflected signal from said standard.

12. A security window system as claimed in claim 11, wherein said means for introducing includes a transducer means at said first waveguide end for generating a compression wave in said waveguide in said lengthwise direction thereof, and means for controlling said transducer in generating said compression wave.

13. A security window system as claimed in claim 12, wherein said transducer is a piezo electric element.

14. A security window system as claimed in claim 11, wherein said means for introducing includes a shear transducer means at said first waveguide end for applying an intermittent transverse wave to said first end of said waveguide, said transverse wave inducing a compression wave which moves lengthwise in said waveguide, and means for controlling said shear transducer in applying said transverse wave.

15. A security window system as claimed in claim 2, wherein said panels and said waveguide are substantially transparent.

16. A security window system as claimed in claim 1, and further comprising a second window panel similar to said first-recited window panel, said second panel being joined to said waveguide and to said first-recited window panel, said waveguide being positioned between said panels.

17. A security window system as claimed in claim 16, wherein the connections of said waveguide and panels are the products of application of at least one of heat and pressure.

18. A security window system as claimed in claim 16, wherein said panels and said waveguide are substantially transparent.

19. A security window system as claimed in claim 1, and further comprising means for introducing a compression wave to said first end of said waveguide said compression wave being transmitted toward said second end;

means for detecting said compression wave arriving at said second end of said waveguide;

means for comparing a characteristic of said detected compression wave against a preselected standard of waveguide transmission performance and for providing a signal indicative of deviation of said arriving wave from said standard.

20. A security window system as claimed in claim 1, and further comprising at least one additional waveguide, said waveguides being spaced apart.

21. A method for detecting penetration of a transparent window panel, comprising the steps:

(a) applying a waveguide to said panel in the region of prospective penetration, said waveguide being substantially indistinguishable visually from said panel and having a different acoustic impedance for compression waves than said panel, said waveguide having a first and a second end;

(b) inducing a compression wave in said waveguide at said first end, said compression wave being transmitted toward said second end;

(c) detecting said compression wave arriving at said second end of said waveguide;

(d) comparing a characteristic of said detected compression wave against a preselected standard of waveguide transmission performance; and (e) producing a signal indicative of deviation of said arriving wave from said standard.

22. A method for detecting penetration of a transparent window panel, comprising the steps:

(a) applying a waveguide to said panel in the region of prospective penetration, said waveguide being substantially indistinguishable visually from said panel and having a different acoustic impedance for compression waves than said panel, said waveguide having a first and a second end;

(b) inducing a compression wave in said waveguide at said first end, said compression wave being transmitted toward said second end and at least in part being reflected therefrom;

(c) detecting said reflected compression wave arriving at said first end of said waveguide;

(d) comparing a characteristic of said detected compression wave against a preselected standard of waveguide transmission performance; and (e) producing a signal indicative of deviation of said arriving wave from said standard.

23. In a security system for a panel having a layer which is transparent to visible light:

waveguide means which is transparent to visible light and is embedded in said panel so as to extend thereacross and is constructed so as to be substantially indistinguishable visually from the panel itself, said waveguide means having a different acoustic impedance for compression waves than said panel.

* * * * *